United States Patent [19]

Ewart

[11] Patent Number: 5,051,744

[45] Date of Patent: Sep. 24, 1991

[54] BOAT ALARM SYSTEM

[76] Inventor: Mark N. Ewart, 12 Horizon Dr., Tiverton, R.I. 02878

[21] Appl. No.: 475,846

[22] Filed: Feb. 6, 1990

[51] Int. Cl.[5] ..... G08B 23/00

[52] U.S. Cl. ..... 340/984; 114/121

[58] Field of Search ..... 340/984, 666, 573, 566; 200/83 N; 114/230, 270, 121; 116/26

[56] References Cited

U.S. PATENT DOCUMENTS

| | | | |
|---|---|---|---|
| 2,212,200 | 8/1940 | Carey . | |
| 3,101,695 | 8/1963 | Honeyman, Jr. . | |
| 3,760,396 | 9/1973 | Haselton . | |
| 3,778,804 | 12/1973 | Adair . | |
| 4,058,792 | 11/1977 | Soltesz . | |
| 4,069,405 | 1/1978 | Fima | 340/566 |
| 4,127,031 | 11/1978 | Barnes . | |
| 4,357,892 | 11/1982 | Sveinsbo et al. | 114/121 |
| 4,510,487 | 4/1985 | Wolfe et al. | 340/573 |

*Primary Examiner*—Donnie L. Crosland
*Assistant Examiner*—Brent A. Swarthout
*Attorney, Agent, or Firm*—Salter & Michaelson

[57] ABSTRACT

An alarm system for a boat includes a sensor unit which is securable to an exterior hull surface of a boat for sensing increased displacement of the boat in the water, such as caused by unauthorized boarding or taking on water. The alarm system further includes a signalling unit in the boat for signalling an attendant or owner when the displacement of the boat has increased and a switching assembly for actuating the system.

7 Claims, 2 Drawing Sheets

BOAT ALARM SYSTEM

BACKGROUND AND SUMMARY OF THE INVENTION

The instant invention relates to boats and more particularly to an alarm system for a boat which is responsive to increased displacement for alerting an owner or attendant of the boat.

In recent years, a significant need has developed for an effective device for alerting an attendant or owner of a boat when an unauthorized boarding of the boat has occurred. In this regard, a large percentage of the md-sized commercial and pleasure boats (between 25 and 65 feet in length) currently in use carry sophisticated and expensive electronic equipment. Because such electronic equipment is often readily removable, the theft of electronic equipment from boats has become a serious problem in recent years. Further, although a wide variety of boat security systems have been heretofore available, most of the previously available security systems have been responsive to entry through hatches, doors, companion ways, etc., rather than boarding. It has been found that security systems which are responsive to entry rather than boarding can often be disarmed before entry takes place, and that in many instances, entry is not required to remove expensive electronic equipment from boats.

While alarm systems which respond to increased displacement of boats have been heretofore available, most of the previously available systems of this type have been less than entirely satisfactory. For example, the system disclosed in the HASELTON U.S. Pat. No. 3,760,396 is adapted so that it is responsive to increased displacement of a boat resulting from unauthorized boarding. However, since this system is adapted to be mounted in the interior bilge area of a boat, it requires the use of through hull piping in the interior bilge area which is in direct open communication with the water beneath the boat. The alarm system disclosed in the BARNES U.S. Pat. No. 4,127,031 is also responsive to increased displacement. However, this system is also adapted to be mounted in the interior bilge area of a boat, and hence it also requires the use of through hull piping to enable it to respond to increased displacement. Other systems which, in addition to the systems disclosed in the aforementioned U.S. Patents to HASELTON and BARNES, represent the closest prior art to the subject invention of which the applicant is aware are disclosed in the CAREY U.S. Pat. No. 2,212,200; HONEYMAN, JR. U.S. Pat. No. 3,101,695; ADAIR U.S. Pat, No. 3,778,804 and SOLTESZ U.S. Pat. No. 4,058,792. However, since none of these systems incorporate a sensor which is mounted on an exterior hull surface of a boat beneath the waterline for sensing increased displacement, they are believed to be of only general interest with respect to the subject invention.

The instant invention provides an effective alarm system which is responsive to increased water pressure on an exterior hull surface of a boat for sensing increased displacement, such as caused by unauthorized boarding or by taking on water. In particular, the alarm system of the subject invention comprises a housing which is adapted to be secured to an exterior hull surface of a boat below the waterline thereof. The housing has an open cylinder formed therein, and the alarm system further comprises a displaceable piston which is received in the cylinder and cooperates therewith to define an air-tight compressible chamber on the exterior of the boat. The piston is received in the cylinder so that it is responsive to water pressure on the exterior of the boat hull for movement between a nondisplaced position wherein the chamber has a first volume and a displaced position wherein the chamber has a reduced second volume. The alarm system further comprises means for resiliently resisting movement of the displaceable piston from the nondisplaced position thereof towards the displaced position thereof and signalling means responsive to movement of the piston from the nondisplaced position thereof to the displaced position thereof for alerting an attendant or owner of the boat. The means for resiliently resisting movement of the piston preferably comprises means for supplying a compressed gas to the chamber in order to resiliently resist movement of the piston toward the displaced position thereof, and more preferably the means for resiliently resisting movement comprises an air compressor for supplying compressed air to the chamber in order to resiliently resist movement of the piston toward the displaced position thereof. The signalling means preferably comprises a fixed contact mounted in a fixed position in the chamber and a movable contact which is movable with the piston toward the displaced position thereof for making electrical contact with the fixed contact. The signalling means preferably comprises a signalling unit which is actuatable in response to electrical contact between the fixed and movable contacts for signalling an attendant or owner of the boat. The device preferably still further comprises switch means for actuating the air compressor to initially move the piston from the displaced position thereof to the nondisplaced position thereof and for thereafter actuating the signalling unit so it is operative in response to electrical contact between the fixed and movable contacts for signalling an owner or attendant of the boat.

It has been found that the device of the instant invention can be effectively utilized for alerting an attendant or owner that the displacement of a boat has been increased, as a result of unauthorized boarding by an intruder, by taking on water, etc. Specifically, it has been found that by mounting the housing and the displaceable piston of the device of the instant invention on an exterior hull surface of a boat below the waterline thereof, the device is extremely sensitive and highly responsive to increased displacement of the boat. However, because it is mounted on an exterior hull surface of the boat, the device does not require through hull piping which introduces water into the interior bilge areas of the boat. It has been further found that by first actuating the compressor to move the displaceable piston from the displaced position thereof to the nondisplaced position thereof and by immediately thereafter deactuating the compressor, the alarm system can effectively compensate for normal changes in the displacement of a vessel, such as caused by variations in the amounts of fuel and/or drinking water on board the vessel. However, once actuated, the system is responsive to increased displacement of the vessel by sensing the increased pressure applied to the exterior surfaces of the displaceable piston. As a result, the alarm system of the subject invention is able to effectively respond to changes in the displacement of the vessel so that an attendant or owner can be alerted.

Accordingly, it is an object of the instant invention to provide an effective alarm system for alerting an attendant or owner of a boat that the displacement of the boat has increased.

Another object of the instant invention is to provide an effective alarm system for a boat which is responsive to boarding by an unauthorized intruder.

A still further object of the instant invention is to provide an alarm system including a sensor portion which is adapted to be mounted on an exterior hull surface of a boat for sensing increased displacement.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated out the present invention.

DESCRIPTION OF THE INVENTION

Figure 1:
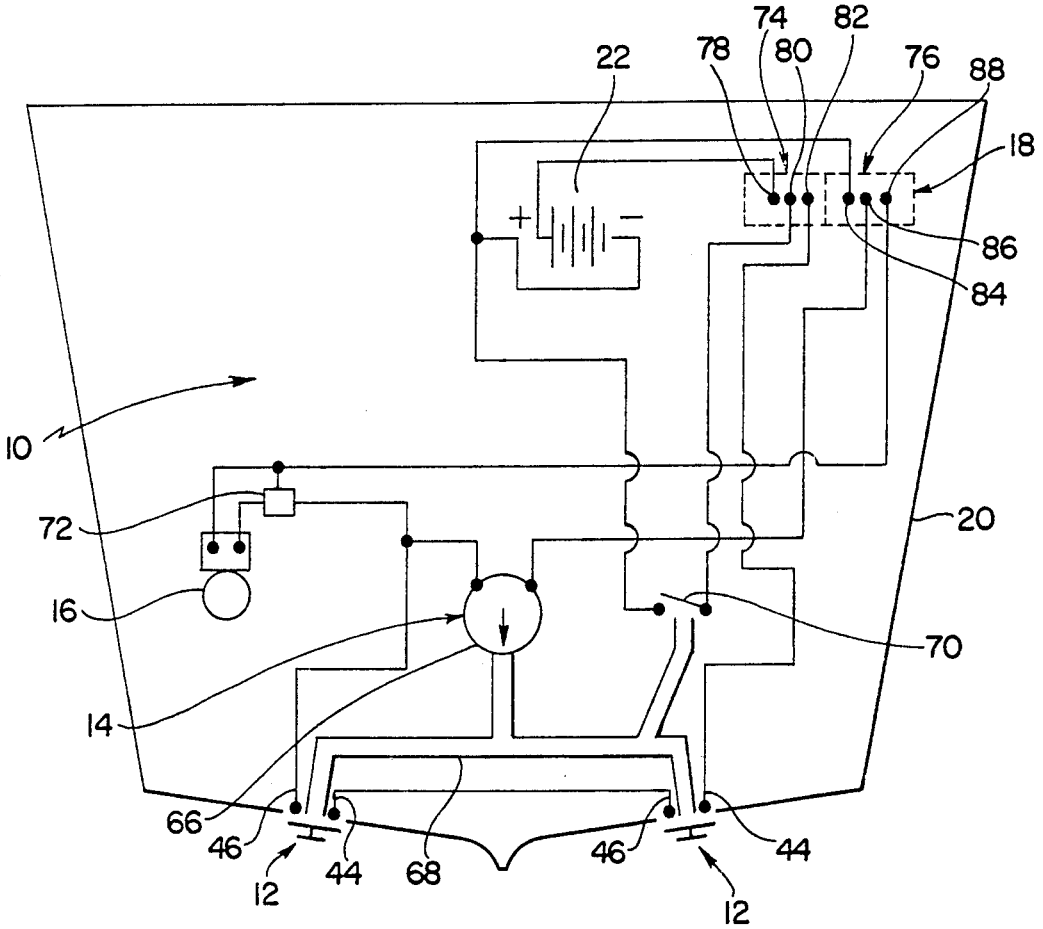
FIG. 1 is a schematic view of the alarm system of the instant invention as mounted on the hull of a boat.

Referring now to the drawings, the alarm system of the instant invention is illustrated and generally indicated at 10 in FIG. 1. The alarm system 10 comprises a pair of sensor units generally indicated at 12, an air compressor assembly generally indicated at 14, a signalling unit 16, and a switch assembly generally indicated at 18. The alarm system 10 is mounted on hull 20 of a boat so that the sensor units 12 are on the exterior surfaces of the hull 20 beneath the waterline thereof. The switch assembly 18, the compressor assembly 14 and the signalling unit 16 are electrically connected to a 12-volt battery 22 in the hull 20 for energizing the alarm system 10. In operation, the sensor units 12 are responsive to increased displacement of the boat hull 20 in the water for actuating the signalling unit 16 to alert an attendant or owner.

Figure 2:
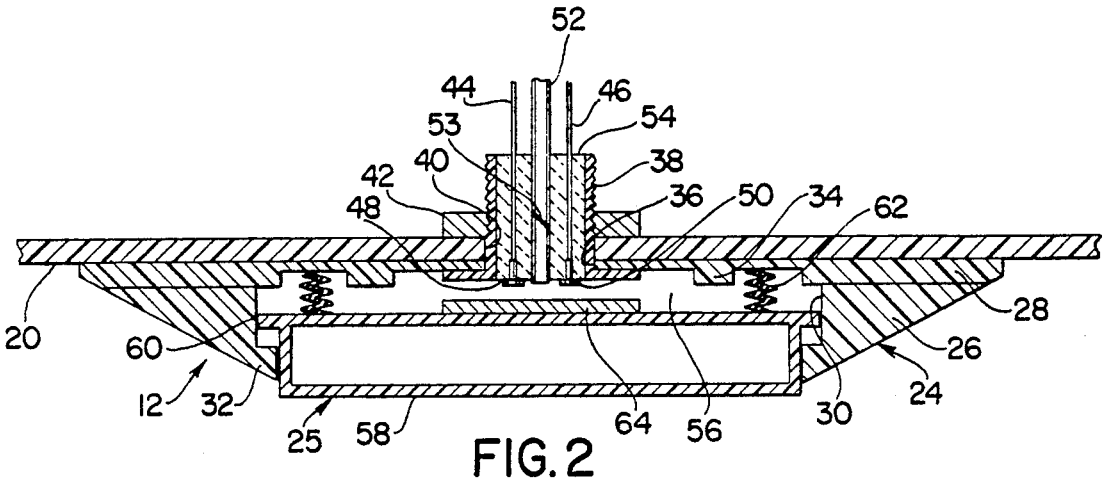
FIG. 2 is a sectional view of the sensor portion of the alarm system mounted on the hull of the boat.
Figure 3:
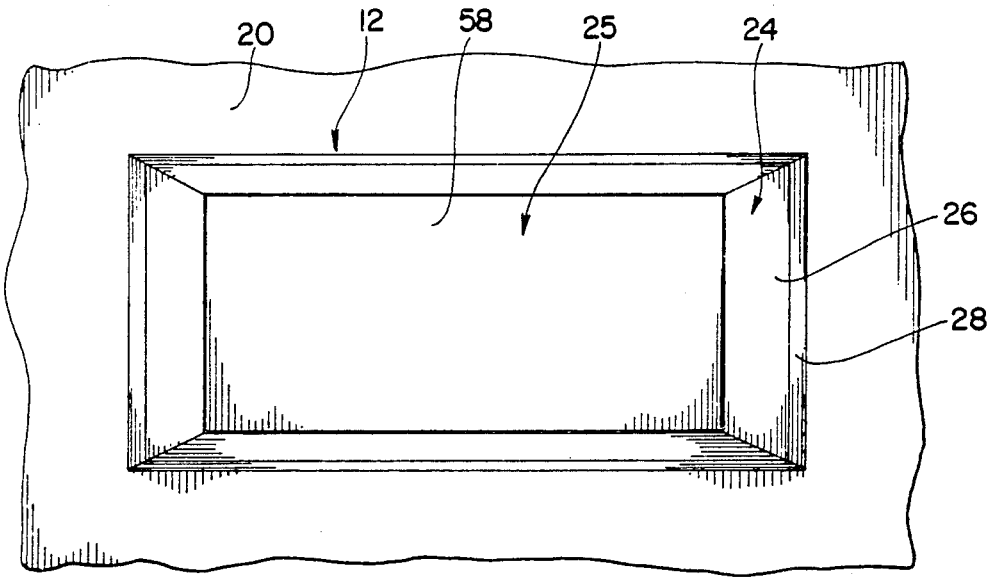
FIG. 3 is a bottom plan view thereof.

Referring to FIGS. 2 and 3, one of the sensor units 12 is illustrated. As will be seen, each of the sensor units 12 comprises a housing assembly generally indicated at 24 containing a movable piston generally indicated at 25. Each of the housings 24 is of generally rectangular configuration, and each is preferably made from a suitable durable rigid plastic material, such as PVC. Each of the housings 24 preferably includes lower and upper casing sections 26 and 28, respectively, which cooperate to define a substantially rectangular open cylinder 30. Each of the lower casing sections 26 includes an inwardly projecting lower lip 32 which defines a reduced open mouth of the cylinder 30. Each of the lower casing sections 26 is preferably permanently secured to the upper casing section 28 thereof, such as by a suitable adhesive and, as illustrated, the lower and upper casing sections 26 and 28 are preferably formed so that the exterior surfaces thereof angle inwardly toward the mouth of the cylinder 30 thereof to provide reduced resistance to waterflow across the sensors 12. Formed in each of the upper casing sections 28 is a pair of downwardly projecting stop elements 34, and a central aperture 36 is also formed in each of the upper casing sections 28. A tubular bronze fitting 38 having a flange at the lower end thereof and male threads on the exterior surface thereof is received in each of the apertures 36, and the fittings 38 are sealingly assembled in bores 40 in the hull 20 so that the upper casing sections 28 are received in engagement with the outer surfaces of the hull 20. A threaded nut 42 is received on each of the fittings 38 on the inner side of the hull 20 for securing the sensors 12. A pair of wires 44 and 46 having contacts 48 and 50 thereon and an air tube 52 having a check valve element 53 therein are received in the interior of each of the fittings 38 and secured therein with potting fill 54. As illustrated in FIG. 2, the wires 44 and 46 are secured in the fittings 38 so that the contacts 48 and 50, respectively, thereon face downwardly in the cylinders 30 and so that the air tubes 52 open downwardly into the cylinders 30.

Each of the pistons 25 is received in the cylinder 30 thereof so that it cooperates with the housing 25 thereof to define a substantially enclosed air-tight chamber 56. The pistons 25 preferably include piston elements 58 which are preferably of substantially rectangular configuration and dimensioned to be received in the cylinders 30 thereof. The piston elements 58 are preferably made in substantially hollow constructions, and they include outwardly projecting upper rims 60 which are dimensioned to travel on the walls of cylinders 30 thereof so that they are engageable with the lips 32 to prevent removal of the piston elements 58 from the cylinders 30. Also included in the pistons 25 are collapsible skirts which are sealingly secured to the upper surfaces of the piston elements 58 and to the lower surfaces of the upper casing sections 28 so that they define the perimeters of the chambers 56 and effectively provide watertight seals between the chambers 56 and the surrounding environment. Also included in the pistons 25 are brass contact plates 64 which are secured to the upper surfaces of the piston elements 58 and positioned so that they are engageable with the respective contacts 48 and 50 thereof when the pistons 25 are at the upper limits of their travel in the cylinders 30.

Accordingly, during use and operation of the sensors 12, pressurized air is supplied to the chambers 56 through the air tubes 52 to maintain the pistons 25 in their lowermost or nondisplaced positions wherein the rims 60 engage the lips 32 and wherein the contacts plate 64 are spaced from their respective contacts 48 and 50. However, when the sensors 12 are exposed to increased water pressure, such as resulting from increased displacement of the boat hull 20 into the water, the pistons 25 are moved upwardly in the chambers 56 to displaced positions wherein the contact plates 64 engage the contact elements 48 and 50 to provide electrical continuity therebetween.

Referring further to FIG. 1, the air compressor assembly 14 comprises an air compressor 66, a pressure tube network 68 and a solenoid valve 70. The air compressor 66 preferably comprises a conventional low-volume, low-pressure rotary air compressor, and it is connected to the pressure tubing 68 for supplying low-pressure (less than 5 PSI) compressed air to the sensor units 12. The tubing network 68 preferably comprises flexible tubing of a type which is capable of withstanding pressures of up to at least 5 PSI. The solenoid valve 70 preferably comprises a normally closed air solenoid valve, and it is connected to the pressure tubing 68 so that pressure can be released from the tubing 68 and the sensors 12 by opening the solenoid valve 70.

The signalling unit 16 preferably comprises a conventional audible alarm unit, such as a conventional 12 volt siren or bell alarm unit, although the use of silent-transmitter-type alarm units is also contemplated. The signalling unit 16 preferably includes a delay relay 72 which is of conventional construction and preferably wired in series with the signalling unit 16 so that it is operative for delaying the actuation of the signalling unit 16 for a period of at least three seconds in order to prevent inadvertent actuation of the alarm system 10 in response to wave action, etc.

The switch assembly 18 comprises first and second switching units 74 and 76, respectively, which are electrically connected to the positive and negative terminals of the battery 22, respectively, for selectively electrically connecting the positive and negative terminals of the battery 22 to the various components of the alarm system 10. The switching units 74 and 76 preferably comprise key switches having two "on" positions and one "off" position each. The first switching unit 74 includes first, second and third terminals 78, 80 and 82, respectively. The first terminal 78 is electrically connected to the positive terminal of the battery 22, and the second terminal 80 is electrically connected to the solenoid valve 70. The third terminal 82 is electrically connected to the wire 44 of a first one of the sensor units 12, and the wire 46 of the first sensor unit 12 is electrically connected to the wire 44 of the second senor unit 12. The wire 46 from the second sensor unit 12 is electrically connected to the compressor unit 66. The first terminal 84 of the second switching unit 76 is electrically connected to the negative terminal of the battery 22, and the second terminal 86 of the second switch unit 76 is electrically connected to the compressor unit 66. The third terminal 86 of the second switch unit 76 is electrically connected to the signalling unit 16, and the signalling unit 16 is also connected to the positive terminal of the compressor 66 through the delay relay 72. Accordingly, during operation of the switch assembly 18, when the first switch unit 74 is moved to the first "on" position thereof, the first terminal 78 is electrically connected to the second terminal 80 to electrically connect the solenoid valve 70 to the positive terminal of the battery 22 causing the solenoid valve 70 to be moved to an open position. By thereafter moving the first switch unit 74 to its second "on" position, the first terminal 78 is disconnected from the second terminal 80 and connected to the third terminal 82 so that the first sensor unit 12 is electrically connected to the positive terminal of the battery 22. As long as the sensor units 12 are in the displaced positions thereof wherein electrical continuity between the contacts 48 and 50 thereof is effected through the contact plates 64 thereof, the compressor unit 66 is electrically connected to the positive terminal of the battery 22 through the sensor units 12. When the second switch unit 76 is moved to the first "on" position thereof, the first terminal 84 is electrically connected to the second terminal 86 to electrically connect the compressor 66 to the negative terminal of the battery 22. Accordingly, when the first switch unit 74 is in the second "on" position thereof and the second switch unit 76 is in the first "on" position thereof, the compressor 66 is energized to supply compressed air to the sensor units 12 as long as the contact plates 64 of the sensor units 12 are in engagement with the respective contacts 48 and 50 thereof. However, when the second switch unit 76 is switched to the second "on" position thereof, the second terminal 86 is disconnected from the first terminal 84, and the first terminal 84 is electrically connected to the third terminal 88 for electrically connecting the alarm unit 16 to the negative terminal of the battery 22, instead of to the compressor 66.

Accordingly, for use and operation of the system 10, the first switch unit 74 is turned from the "off" position thereof to the first "on" position thereof and then to the second "on" position thereof so that the solenoid valve 70 is in a closed position and the sensor units 12 and the compressor unit 66 are electrically connected to the positive terminal of the battery 22 as long as the movable contact plates 64 are in contact with their respective terminals 48 and 50. When the second switch 76 is then moved to the first "on" position thereof, the compressor 66 is electrically connected to the negative terminal of the battery 22 so that the compressor 66 operates to supply pressurized air to the chambers 56 in the sensor units 12. As the pressure in the chambers 56 begins to increase, the pistons 25 are moved downwardly causing the contact plates 64 thereof to be separated from their respective contacts 48 and 50. This causes the compressor 66 to be automatically deactuated. Thereafter, by moving the second switch unit 76 to the second "on" position thereof, the first terminal 84 is disconnected from the second terminal 86, and it is electrically connected to the third terminal 88 to set the signalling unit 16. However, since the signalling unit 16 is electrically connected to the positive terminal of the battery 22 through the sensor units 12, it remains unactuated as long as the contact plates 64 are spaced from their respective contacts 48 and 50. However, in the event that the displacement of the boat hull 20 is increased so that the sensor units 12 are move downwardly in the water, the pressure from the water causes the pistons 25 to be again brought into engagement with their respective contacts 48 and 50. When this occurs, the alarm unit 16 is electrically connected to the positive terminal of the battery 22 through the relay 72 and the sensors 12. Accordingly, if the contact plates 64 remain in electrical contact with their respective contacts 48 and 50 for a period of at least three seconds, the alarm unit 16 is activated through the delay relay 72 to produce an audible alarm signal which indicates that the displacement of the boat hull 20 has increased. As a result, anyone in the vicinity of the boat comprising the hull 20 is alerted to the fact that the boat may have been boarded by an unauthorized intruder or taken on an excessive quantity of water.

It is seen therefore that the instant invention provides and effective alarm system for a boat. The alarm system 10 is responsive to increased displacement of the boat hull 20 for actuating the alarm unit 16. Accordingly, an attendant or owner is alerted to the fact that the displacement of the boat hull 20 has increased so that the reason for the increased displacement can be investigated. In this regard, because the sensor units 12 are mounted on the exterior surfaces of the hull 20 below the waterline thereof, they are highly responsive to increased displacement of the hull 20. Further, the system 10 does not require internal water piping in the interior bilge areas of the hull 20 for sensing water pressure. Accordingly, it is seen that the alarm system of the instant invention represents a significant advancement of the art which has substantially commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An alarm system for a boat, said boat including a hull having a waterline, said alarm system comprising a housing adapted to be secured to an exterior surface of said boat below the waterline thereof, said housing having an open cylinder formed therein, displaceable means cooperating with said cylinder to define an airtight compressible chamber, said displaceable means being responsive to increased water pressure on the exterior of said boat hull for movement from a nondisplaced position wherein said chamber has a first volume to a displaced position wherein said chamber has a reduced second volume; means for resiliently resisting movement of said displaceable means from said nondisplaced position thereof torward said displaced position thereof and signalling means responsive to movement of said displaceable means from said nondisplaced position thereof to said displaced position thereof for alerting an attendant of said boat.

2. In the alarm system of claim 1, said displaceable means further characterized as piston means sealingly received in said chamber for movement between nondisplaced and displaced positions thereof, said means for resiliently resisting movement resiliently resisting movement of said piston means from said nondisplaced position thereof toward said displaced position thereof, said signalling means being responsive to movement of said piston means from said nondisplaced position thereof to said displaced position thereof for alerting said attendant of said boat.

3. In the device of claim 1, said means for resiliently resisting movement of said displaceable means comprising means for supplying a compressed gas to said chamber for resiliently resisting movement of said displaceable means toward said displaced position thereof.

4. In the device of claim 1, said means for resiliently resisting movement of said displaceable means comprising air compressor means for supplying compressed air to said chamber for resiliently resisting movement of said displaceable means toward said displaced position thereof.

5. In the device of claim 1, said signalling means comprising a fixed contact and a movable contact, said movable contact traveling with said displaceable means upon movement thereof toward said displaced position for making electrical contact with said fixed contact, said signalling means further comprising a signalling unit actuatable for operating in response to electrical contact between said fixed and movable contacts for signalling said attendant of said boat.

6. In the device of claim 4, said signalling means comprising a fixed contact and a movable contact, said movable contact traveling with said displaceable means upon movement thereof toward said displaced position for making electrical contact with said fixed contact, said signalling means further comprising a signalling unit actuatable in response to electrical contact between said fixed and movable contacts for signalling said attendant of said boat.

7. The device of claim 6, further comprising switch means for actuating said compressor means to initially move said displaceable means from said displaced position thereof to said nondisplaced position thereof and for thereafter actuating said signalling unit so that it is operative in response to electrical contact between said fixed and movable contacts for signalling said attendant of said boat.

* * * * *